US007650724B2

(12) United States Patent
Hallett et al.

(10) Patent No.: US 7,650,724 B2
(45) Date of Patent: Jan. 26, 2010

(54) TUBE WITH EXTERNAL CHANNEL

(75) Inventors: Richard Andrew Hallett, Cumberland, ME (US); Richard Anthony Dowzall, Portland, ME (US)

(73) Assignee: Hallett Canvas & Sails, Inc., Falmouth, ME (US)

( * ) Notice: Subject to any disclaimer, the term of this patent is extended or adjusted under 35 U.S.C. 154(b) by 787 days.

(21) Appl. No.: 11/080,917

(22) Filed: Mar. 11, 2005

(65) Prior Publication Data

US 2006/0201104 A1 Sep. 14, 2006

(51) Int. Cl.
*E04C 3/00* (2006.01)
*E04H 15/40* (2006.01)
*B63B 17/02* (2006.01)

(52) U.S. Cl. ..... 52/222; 52/844; 135/127; 114/361

(58) Field of Classification Search ..... 52/843, 52/222, 81.2, 81.3, 63, 848, 844; 114/361; 248/49, 51, 68.1; 138/177, 178, 118, 115, 138/117, 114
See application file for complete search history.

(56) References Cited

U.S. PATENT DOCUMENTS 3,040,849 A * 6/1962 Abberly ..... 52/834
3,071,350 A * 1/1963 Opie ..... 256/65.08
3,311,274 A * 3/1967 Green ..... 222/402.18
3,691,713 A * 9/1972 Dulaney ..... 52/204.591
3,811,454 A * 5/1974 Huddle ..... 135/124
4,369,000 A * 1/1983 Egnew ..... 403/13
4,838,294 A * 6/1989 Hunt ..... 135/124
4,887,626 A * 12/1989 Dalo et al. ..... 135/119
4,977,722 A * 12/1990 Taylor ..... 52/204.595
5,379,566 A * 1/1995 Schworer ..... 52/632
5,555,695 A * 9/1996 Patsy, Jr. ..... 52/843
5,661,945 A * 9/1997 Henriksson et al. ..... 52/846
5,702,147 A * 12/1997 Essig ..... 296/106
5,779,228 A * 7/1998 Hansen ..... 256/65.05
D408,560 S * 4/1999 Bruder ..... D25/122
5,979,119 A * 11/1999 Trafton ..... 52/40
6,408,587 B2 * 6/2002 Cronin et al. ..... 52/637
6,463,960 B1 * 10/2002 Madhani et al. ..... 138/98
6,554,235 B1 * 4/2003 Fortier ..... 248/122.1
6,647,692 B1 * 11/2003 Roder ..... 52/843
6,668,495 B1 * 12/2003 Prince ..... 52/63
7,063,096 B2 * 6/2006 Stoeckler ..... 135/114
2002/0026765 A1 * 3/2002 Vahey ..... 52/732.1
2003/0163966 A1 * 9/2003 Reynolds et al. ..... 52/461
2004/0168383 A1 * 9/2004 Reynolds et al. ..... 52/273
2009/0223455 A1 * 9/2009 Petterson et al. ..... 119/14.51

* cited by examiner

*Primary Examiner*—Richard E Chilcot, Jr.
*Assistant Examiner*—Brent W Herring
(74) *Attorney, Agent, or Firm*—Patricia M. Mathers

(57) ABSTRACT

A tube with an external channel of a complex geometry. The channel does not distort or collapse when the tube is bent 90 degrees with a 4-inch radius. Fabric may be inserted into and securely held in the external channel. The tube is suitable for constructing frames of fabric structures, such as dodgers and biminis for boats, tents, chairs, etc.

9 Claims, 4 Drawing Sheets

TUBE WITH EXTERNAL CHANNEL

BACKGROUND INFORMATION

1. Field of the Invention

The invention relates to the field of tubes or pipes. More particularly, the invention relates to a tube with an external channel.

2. Description of the Prior Art

Tubing, particularly aluminum tubing, is frequently used for building tube frames, such as the frames for biminis and dodgers on boats. Other common uses for such tube frames include collapsible beach chairs, tents, baby strollers, etc. Common to the types of frames just mentioned is that the frame is used to support a fabric structure, such as the dodger enclosure on a boat, the seat and back rest on the chair, etc. The tubing is a suitable material for the frame because it is lightweight, yet strong. It is also easily bendable with a pipe bender, so it can be used to construct and shape a frame to fit a particular substructure. Although it is understood that there are innumerable uses for such tube frames, for purposes of illustration, reference will be made hereinafter to a "dodger" and frame for a dodger, whereby the dodger is representative of any fabric structure supported on a tube frame.

One of the disadvantages of the tube frame is that the fabric has to be fitted over the frame. In the case of the beach chair, the two ends of the fabric seat are provided with a tube or sleeve that slides over the tubing. More complex structures comprise a number of panels, such as two side panels, a front panel, a top panel, and a back panel. Such a complex structure is a boat enclosure called a "dodger." Because of the need to fit the fabric structure over the frame, the panels are stitched together to form a unitary construction that is fitted over the tube frame. Often, two adjacent panels are stitched together and a sleeve stitched over the seam, so that a section of the tube frame is insertable through the sleeve. This unitary construction creates difficulties because the fabric structure is bulky and heavy, making it difficult to handle. If one panel requires cleaning or repair, the entire structure has to be removed from the frame for delivery to a cleaning or repair facility.

Another disadvantage of the conventional tube frame is that the fabric often bunches up on the frame, providing an unaesthetic look. The bunching up may create folds in the fabric, which promote mildew and growth of mold, because moisture becomes trapped in the folds.

What is needed, therefore, is a bendable tube that enables individual panels of fabric to be secured to it, without requiring that the fabric be secured with a sleeve of fabric or that adjacent panels be stitched together. What is further needed is a tube frame made of such a tube and a means of securing fabric panels smoothly and evenly to the frame. What is yet further needed is such a tube frame that provides an aesthetically pleasing appearance.

BRIEF SUMMARY OF THE INVENTION

The invention is a metal tube with an external channel that does not distort or collapse when the tube is bent. The tube is extruded of anodized aluminum. The geometry of the channel is complex and allows the tube to be bent without collapsing, even when bent about a relatively small radius. The channel is not circular or rectangular, but of a curved, somewhat teardrop shape. The inner hollow core of the tube is somewhat oval in cross-section. The tube may have one, two, three or more external channels, depending on its intended use. A tongue forms a dividing wall between any two adjacent channels.

The sections of a frame to which fabric is to be attached are made of the tube according to the invention. Individual panels of the fabric are attached to the frame. The edge of the panel to be secured to the frame is provided with a contoured, flexible border that is slidingly insertable in and capturable within the channel. Suitable materials for providing the border include foam piping material, cord, rope or braid, or other firm materials that will bend around the contours of the frame but are firm enough to remain captured within the channel. Individual sliders, such as are used to attach drapes to channel track, may also be used. If two panels of fabric are attached to the same section of a two-channel tube, the edge of one panel is inserted into the first channel and the edge of the second panel into the second channel.

An example of a tube that is particularly well suited for a dodger frame is one that is extruded from 6061-T6 aluminum and anodized. This material provides a tube that is pleasing in appearance and has the desired light weight and high strength for securing heavy fabric on a straight or curved stretch of tube. The tube is 1" in diameter, with the walls and bridge ⅛" thick. A tube of these dimensions can be bent to a radius as small as four inches, without the channels collapsing or distorting.

The individual panels of fabric are secured to the frame by inserting the edge of the fabric into the external channel. The fabric is smoothly and evenly secured to the tube, along straight and curved sections and the finished look is smooth and elegant. When two panels are attached to the same section of tube, a portion of the tongue between the two channels remains visible, which provides a clean and contrasting look that is aesthetically appealing.

The tube according to the invention may also be provided as a telescoping tube. An inner or connector tube is slidingly inserted into the hollow tube core of the tube. A setscrew or other suitable means is used to secure the connector tube at a particular distance within the tube.

A feeder or endcap may be used to provide a finished end to the tube and also to help insert the fabric edge into the channel. The endcap has a hollow core with a threaded bore, and two external channels with end openings. The hollow core and threaded bore align with the hollow core of the tube. A screw-in eyeend may be threaded into the threaded bore, for attaching the frame to a boat deck, a wall, or other support structure.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
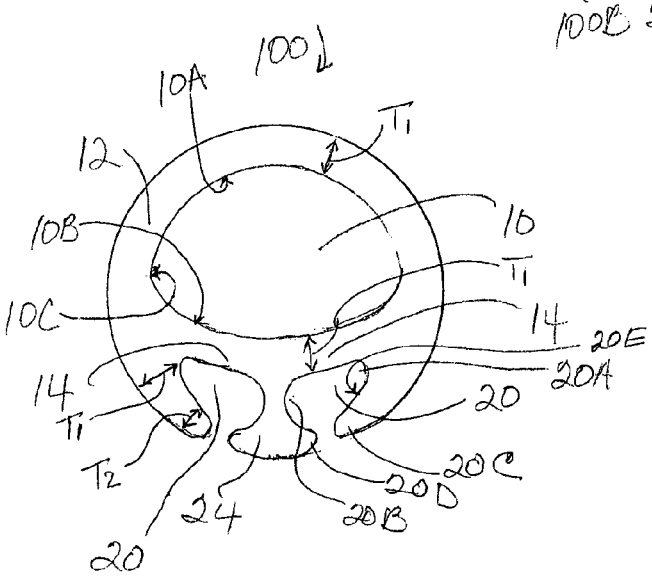
FIG. 1 is a cross-sectional view of the tube according to the invention, showing the geometry of the channels, the bridge and the tongue.

FIG. 1 is a cross-sectional view of a tube 100 according to the invention, showing an inner hollow core 10 and a channel 20. It is the shape and configuration of the channel 20 that is unique to the invention and it is understood that, depending on the particular intended use, one, two, three, or more channels 20 may be provided in the tube 100. The tube 100 has a tube wall 12 that forms a bridge 14 in the area of the channel 20. The inner hollow core 10 is delineated by a first inner wall section 10A and a second inner wall 10B. The channel 20 has a complex geometry that is delineated by a first curve 20A, a second curve 20B, a first channel arm 20C and a second channel arm 20D. In the embodiment shown, two channels 20 are provided in the tube wall 12 with a tongue 24 therebetween. The two channels 20 are in mirror-reverse juxtaposition to each other and the tongue 24 forms the second curve 20B and the second channel arm 20D for both of the channels 20. The tube wall 12 and bridge 14 have a first thickness T1. The first channel arm 20C has thickness T1 at its base and tapers to a second thickness T2, which is ½ the first thickness T1. The radius of curvature of the first curve 20A is significantly smaller than the radius of curvature of the second curve 20B.

Figure 2:
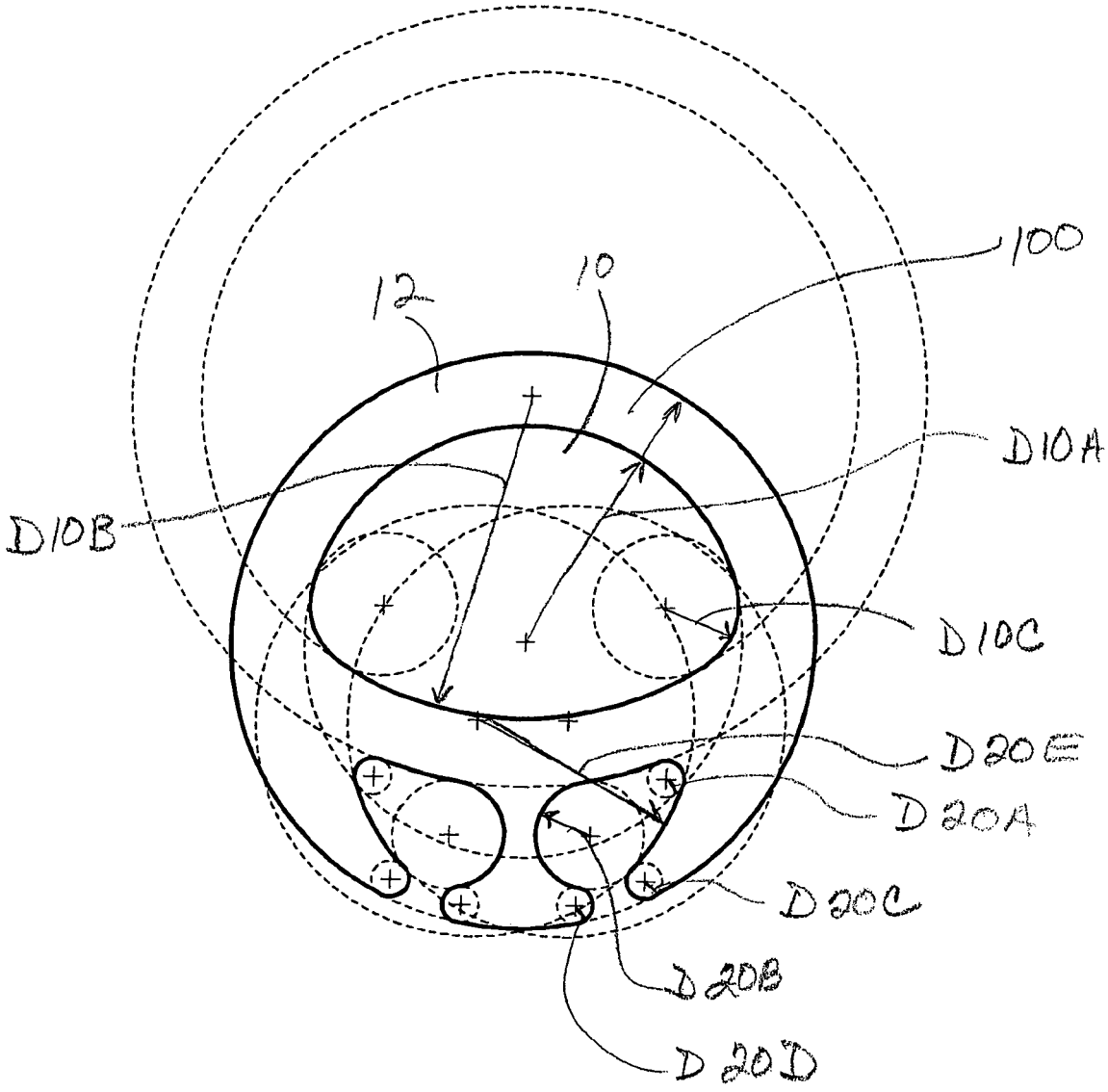
FIG. 2 is the cross-sectional view of the tube of FIG. 1, illustrating with greater detail the radii of the curves that form the channel and the inner hollow core.

FIG. 2 shows the radii or diameters of the various curves. The diameters of a one-inch overall outside diameter tube will be given here for purposes of illustration only. It is understood that the tube 100 according to the invention is not limited to a one-inch outside diameter tube. A person skilled in the art understands that the radii of the various curves will be adapted proportionally to form tubes according to the invention of other diameters. D10A is the overall diameter of the tube: one inch overall outside diameter and ¾ inch overall inside diameter of the first inner wall section 10A. D10B defines the curve of the second inner wall section 10B, which is 1⅛ inch in diameter. D10C defines the transition curve 10C between the first inner wall section 10A and the second inner wall section 10B. D20E defines the curvature 20E of the first channel arm; D20A defines the diameter of the first curve 20A; and D20B the diameter of the second curve 20B. D20D defines the curvature of the outer end of the second channel arm 20D.

Figure 3A:
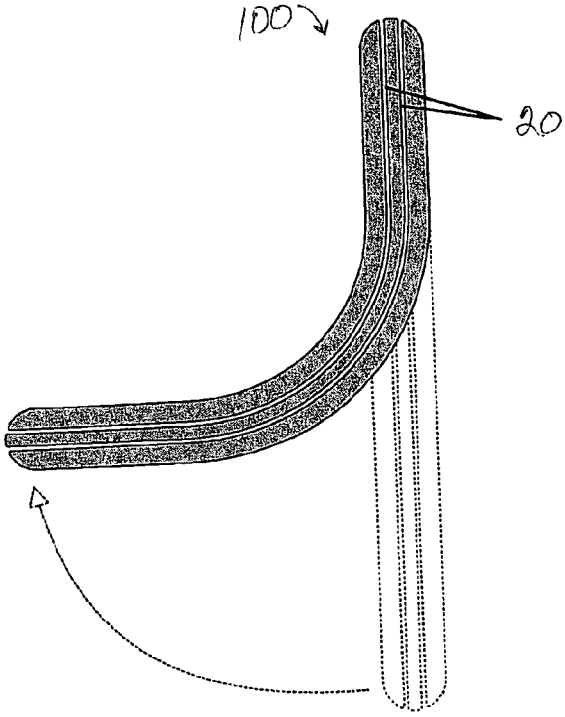
FIG. 3A illustrates a side bend on the tube of FIG. 1.
Figure 3B:
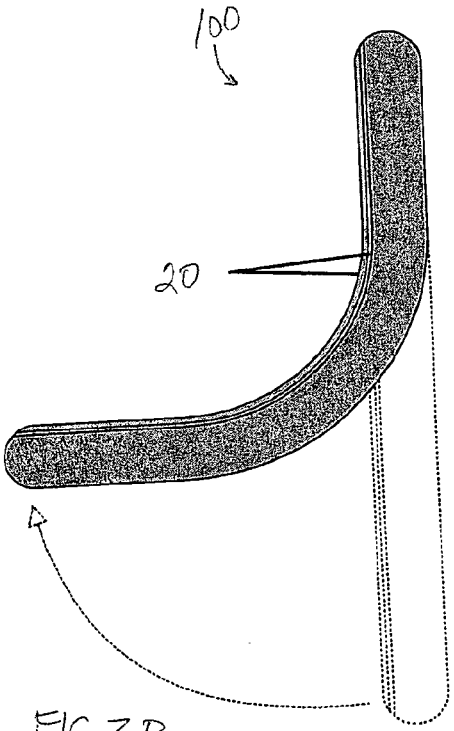
FIG. 3B ilustrates an inside bend on the tube of FIG. 1.
Figure 3C:
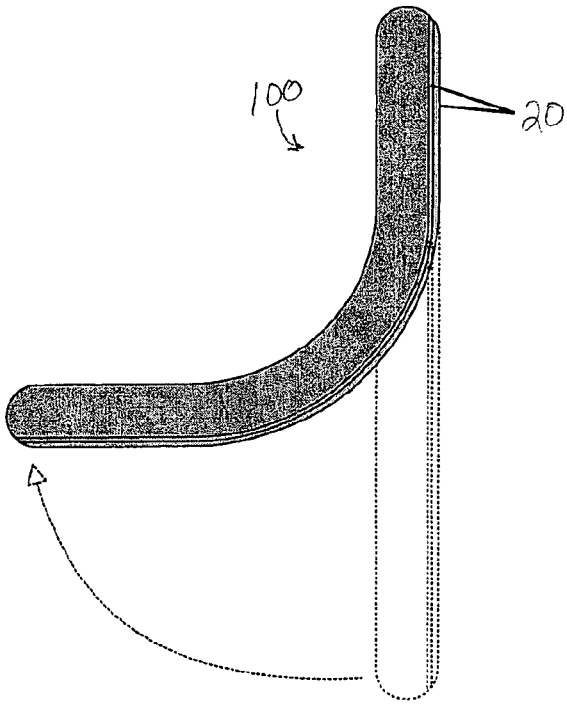
FIG. 3C illustrates an outside bend on the tube of FIG. 1.

FIGS. 3A-3C show the tube 100 with a 90 degree bend in a 4-inch radius, with a side bend, an inside bend, and an outside bend. The channel 20 does not distort to any significant degree with any of these bends.

Figure 4:
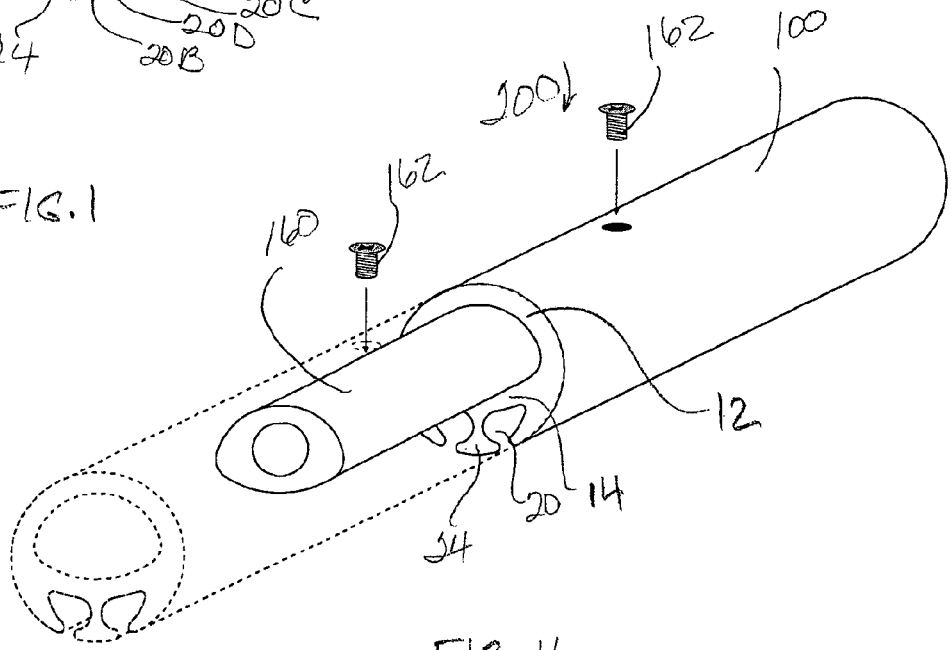
FIG. 4 is a perspective view of a telesoping tube according to the invention.

FIG. 4 is a perspective view of a telescoping tube 200 according to the invention, showing an inner tube 160, also called a connector, slidably inserted into the hollow core 10 of the tube 100. Setscrews are shown as a means 162 of fixing the telescoping distance of the connector 160 relative to the tube 100.

Figure 5A:
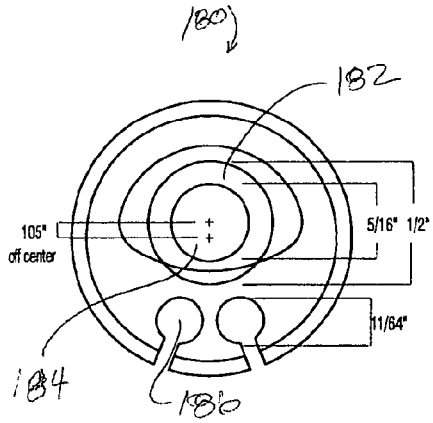
FIG. 5A is a frontal view of an end cap.
Figure 5B:
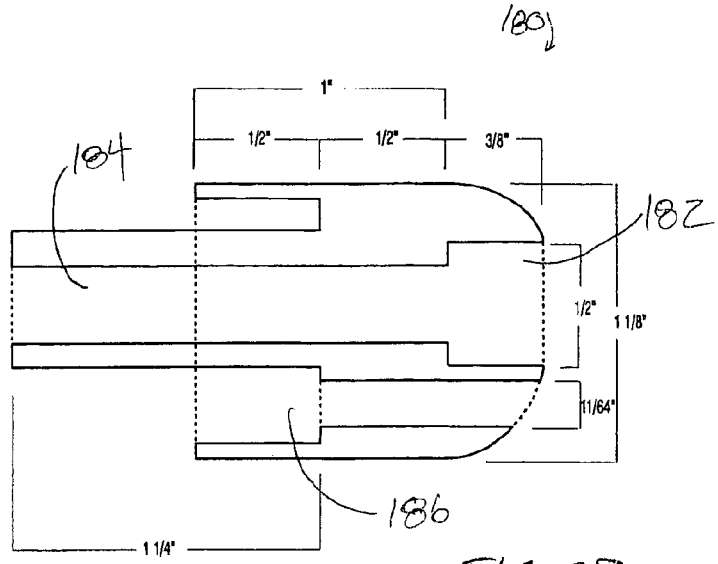
FIG. 5B is a side view of the end cap.

FIGS. 5A and 5B are views of an end cap 180 that is used to close the end of the tube 100. The end cap 180 has a central throughbore 184. A threaded bore 182 is provided at the beginning of the throughbore 184. An external channel 186 is formed in the endcap 180. The number of external channels 186 and their alignment on the endcap 180 correspond to the number of external channels 20 and their alignment on the tube 100 with which the endcap 180 is to be used.

Figure 6:
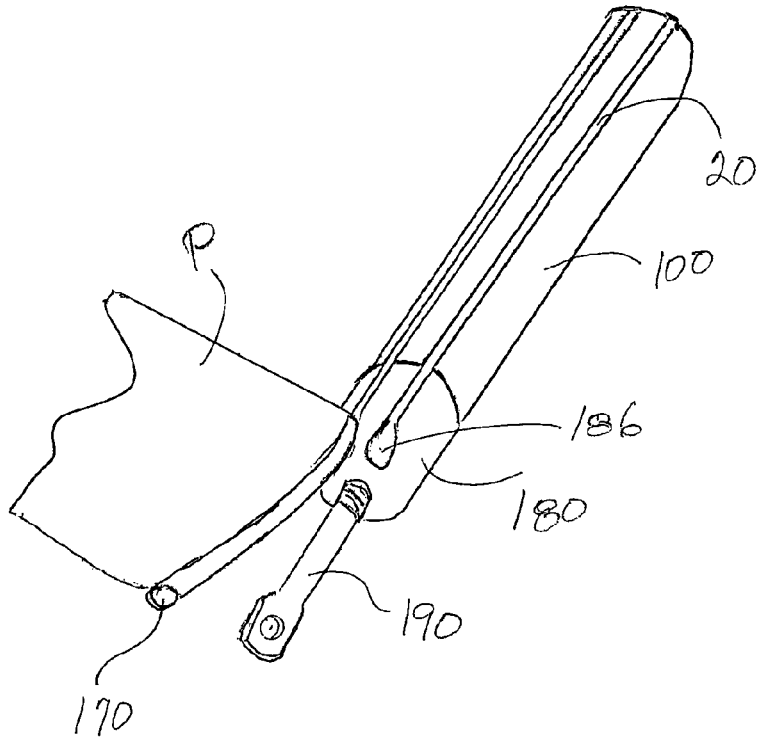
FIG. 6 illustrates a reinforced fabric edge being inserted into a channel.

FIG. 6 illustrates use of the endcap 180 as a feeder, showing a panel P of fabric being inserted into a tube 100 through the endcap 180. The external channel 186 in the endcap 180 is preferably provided with a feeder opening, which facilitates insertion of the panel P. A fabric attachment means 170 is attached to an edge of the panel P as shown and slidingly inserted into the external channel 186 and then into the external channel 20. In the embodiment shown, the fabric attachment means 170 is a foam piping enclosed within a sleeve of the fabric. Other suitable fabric attachment means include rope, chord, or braid, individual sliders, or other means that are attachable to the panel P and capturable by the channel arms 20C and 20D. As shown in FIG. 6, the fabric attachment means 170 is circular in diameter and does not correspond precisely to the shape of the channel 20. Nevertheless, the diameter is great enough that it remains captured in the channel 20 by the first and second channel arms 20C and 20D. Also shown in FIG. 6 is frame attachment means 190 which is threaded into the threaded bore 182 on the endcap 180. Illustrative of a suitable frame attachment means 190 is the endeye shown in this embodiment. The frame attachment means 190 is any suitable device that enables the frame 300 to be attached to the deck of a boat, to a wall, or other structural support.

Figure 7:
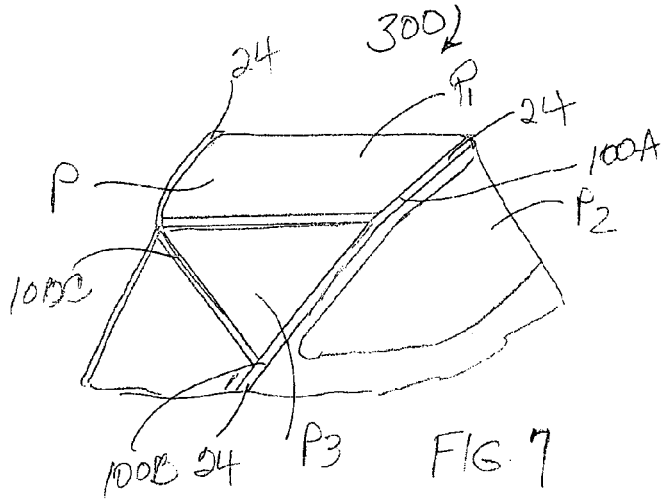
FIG. 7 is an illustration of a dodger for a boat, constructed of fabric panels that are individually attached to sections of the tube frame.

FIG. 7 is an illustration of a boat enclosure 300, such as a dodger, constructed of a frame made of the multiple sections 100A, 100B, . . . of the tube 100. Panels P of fabric are secured to the frame. A first panel P1 and a second panel P2 are secured in the channels on a first section 100A. Only the tongue 24 of the tube section 100A is visible on the outside of the enclosure 300.

It is understood that the embodiments described herein are merely illustrative of the present invention. Variations in the construction of the tube, a frame constructed of the tube, and a fabric structure supported by the frame may be contemplated by one skilled in the art without limiting the intended scope of the invention herein disclosed and as defined by the following claims.

What is claimed is:

1. A tube comprising:

an inner hollow core bounded by an inner wall that consists of a first portion that is defined by a first curve based on a first circle having a first diameter, a second portion that is defined by a second curve based on a second circle having a second diameter that is greater than said first diameter, and a third portion that includes a pair of third curves, each third curve based on a third circle having a third diameter that is smaller than said first diameter and said second diameter, a first one of said third curves serving to smoothly transition between a first end of said first portion and a first end of said second portion and a second one of said third curves serving to smoothly transition between a second end of said first portion and a second end of said second portion, an outer wall with an overall circular circumference; and an external channel formed in said outer wall, said external channel extending parallel to a longitudinal axis of said inner hollow core, said external channel being bounded by a first channel curve formed by a first channel arm, said first channel curve being defined by a first radius, and a second channel curve formed by a second channel arm, said second channel curve being defined by a second radius, wherein said second radius is different from said first radius and a curvature of said first channel arm is different from a curvature of said second channel arm.

2. The tube of claim 1, wherein said external channel includes more than one channel.

3. The tube of claim 2, wherein said more than one channel includes a first channel and a second channel in mirror-reverse juxtaposition to each other.

4. The tube of claim 1, wherein said inner hollow core, said outer wall, and said external channel are formed with a ninety-degree bend, without a distortion of said external channel.

5. The tube of claim 4, wherein said ninety-degree bend has a radius that is as small as four inches.

6. The tube of claim 5, wherein said bend is an inside bend with said external channel on an inside curvature of said inside bend.

7. The tube of claim 1, wherein said external channel has a continuously curved contour.

8. The tube of claim 1, wherein said inner hollow core has a continuously curved contour.

9. A telescoping tube comprising:

an inner tube; and an outer tube having an overall circular circumference;

wherein said outer tube includes an inner hollow core bounded by an inner wall an outer wall, and an external channel formed in said outer wall, said external channel extending parallel to a longitudinal axis of said inner hollow core, said channel being bounded by a first channel curve formed by a first channel arm, said first channel curve being defined by a first radius, and a second channel curve formed by a second channel arm, said second channel curve being defined by a second radius;

wherein said second radius is different from said first radius and a curvature of said first channel arm is different from a curvature of said second channel arm;

wherein said inner hollow core is defined by a first curve based on a first circle having a first diameter, a second curve based on a second circle having a second diameter that is greater than said first diameter, and a pair of third curves, each third curve based on a third circle having a third diameter that is smaller than that of said first diameter and of said second diameter, a first one of said third curves serving to smoothly transition between a first end of said first curve and a first end of said second curve and a second one of said third curves serving to smoothly transition between a second end of said first curve and a second end of said second curve, and wherein said inner tube is slidably insertable into said inner hollow core of said outer tube.

* * * * *